US007273584B2

(12) United States Patent
Ohtsuka et al.

(10) Patent No.: US 7,273,584 B2
(45) Date of Patent: Sep. 25, 2007

(54) METHOD OF MANUFACTURING OXIDE DISPERSION STRENGTHENED MARTENSITIC STEEL EXCELLENT IN HIGH-TEMPERATURE STRENGTH HAVING RESIDUAL α-GRAINS

(75) Inventors: Satoshi Ohtsuka, Higashi-Ibaraki-gun (JP); Shigeharu Ukai, Higashi-Ibaraki-gun (JP); Takeji Kaito, Higashi-Ibaraki-gun (JP); Takeshi Narita, Higashi-Ibaraki-gun (JP); Masayuki Fujiwara, Kobe (JP)

(73) Assignee: Japan Nuclear Cycle Development Institute, Ibaraki-Ken (JP)

( * ) Notice: Subject to any disclaimer, the term of this patent is extended or adjusted under 35 U.S.C. 154(b) by 437 days.

(21) Appl. No.: 10/928,119

(22) Filed: Aug. 30, 2004

(65) Prior Publication Data

US 2005/0084406 A1 Apr. 21, 2005

(30) Foreign Application Priority Data

Sep. 1, 2003 (JP) ..... 2003-308458

(51) Int. Cl.
*C22C 1/05* (2006.01)
*C22C 33/02* (2006.01)

(52) U.S. Cl. ..... 419/19; 419/29; 419/32; 419/33; 419/48

(58) Field of Classification Search ..... 419/20, 419/41, 19
See application file for complete search history.

(56) References Cited

U.S. PATENT DOCUMENTS 3,696,486 A * 10/1972 Benjamin ..... 75/230
3,738,817 A * 6/1973 Benjamin ..... 75/235

(Continued)

FOREIGN PATENT DOCUMENTS

FR 2 731 231 9/1996

(Continued)

OTHER PUBLICATIONS

Shigeharu Ukai et al., "Production and Properties of Nano-scale Oxide Dispersion Strengthened (ODS) 9Cr Martensitic Steel Claddings", ISIJ International, vol. 43, No. 12, pp. 2038-2045, XP008063569, 2003.

(Continued)

*Primary Examiner*—Roy King
*Assistant Examiner*—Christopher Kessler
(74) *Attorney, Agent, or Firm*—Wenderoth, Lind & Ponack, L.L.P.

(57) ABSTRACT

An oxide dispersion strengthened martensitic steel excellent in high-temperature strength having residual α-grains can be manufactured by a method comprising mixing either element powders or alloy powders and a $Y_2O_3$ powder; subjecting the resulting mixed powder to mechanical alloying treatment; solidifying the resulting alloyed powder by hot extrusion; and subjecting the resulting extruded solidified material to final heat treatment involving normalizing and tempering heat treatment to thereby manufacture an oxide dispersion strengthened martensitic steel in which $Y_2O_3$ particles are dispersed in the steel, wherein αto γtransformation is not allowed to occur during the described hot extrusion and the proportion of residual α-grains in which oxide particles are finely dispersed in high density is increased by controlling the mixture ratio of the powders for the mechanical alloying treatment.

1 Claim, 8 Drawing Sheets

U.S. PATENT DOCUMENTS

| | | | | |
|---|---|---|---|---|
| 4,075,010 | A * | 2/1978 | Fischer | 75/235 |
| 4,586,957 | A * | 5/1986 | Masumoto et al. | 420/42 |
| 4,963,200 | A | 10/1990 | Okuda et al. | |
| 5,047,096 | A * | 9/1991 | Eriksson et al. | 148/325 |
| 5,856,625 | A * | 1/1999 | Saunders et al. | 75/236 |
| 6,176,946 | B1 * | 1/2001 | Kuehmann et al. | 148/319 |
| 6,485,584 | B1 * | 11/2002 | Lambard et al. | 148/514 |
| 6,890,393 | B2 * | 5/2005 | Buck | 148/325 |
| 6,899,773 | B2 * | 5/2005 | Buck | 148/325 |
| 6,974,506 | B2 * | 12/2005 | Lambard et al. | 148/325 |
| 7,037,464 | B2 * | 5/2006 | Ohtsuka et al. | 419/19 |
| 2003/0116239 | A1 * | 6/2003 | Lambard et al. | 148/607 |
| 2004/0154706 | A1 * | 8/2004 | Buck | 148/609 |
| 2004/0154707 | A1 * | 8/2004 | Buck | 148/609 |
| 2006/0065327 | A1 * | 3/2006 | Buck | 148/325 |
| 2006/0118208 | A1 * | 6/2006 | Morikawa et al. | 148/326 |

FOREIGN PATENT DOCUMENTS

| | | |
|---|---|---|
| GB | 2 219 004 | 11/1989 |
| JP | 5-18897 | 3/1993 |

OTHER PUBLICATIONS

Shigeharu Ukai et al., "Perspective of ODS alloys application in nuclear environments", Journal of Nuclear Materials, vol. 307-311, pp. 749-757, XP004400792, ISSN: 0022-3115, 2002.

S. Ukai et al., "Alloying design of oxide dispersion strengthened ferritic steel for long life FBRs core materials", Journal of Nuclear Materials, No. 204, pp. 65-73, XP008063557, 1993.

* cited by examiner

Y1 (Ti=0.20wt%, ExO=0.026wt%)

Y2 (Ti=0.20wt%, ExO=0.044wt%)

E7(equivalent to Mm11)
(Ti=0.20wt%, ExO=0.087wt%)

T3 (Ti=0.21wt%, ExO=0.15wt%)

T5 (Ti=0.46wt%, ExO=0.17wt%)

Dependence of Vickers hardness and an area rate of residual α-grains on TiOx

Dependence of Vickers hardness and an area rate of residual α-grains on estimated amount of dissolved C High-temperature creep properties High-temperature tensile properties Dependence of creep rupture strength at 700°C for 1,000 hrs on TiOx Dependence of tensile strength on TiOx

METHOD OF MANUFACTURING OXIDE DISPERSION STRENGTHENED MARTENSITIC STEEL EXCELLENT IN HIGH-TEMPERATURE STRENGTH HAVING RESIDUAL α-GRAINS

BACKGROUND OF THE INVENTION

The present invention relates to a method of manufacturing an oxide dispersion strengthened (ODS) martensitic steel excellent in high-temperature strength.

The oxide dispersion strengthened martensitic steel of the present invention can be advantageously used as a fuel cladding tube material of a fast breeder reactor, a first wall material of a nuclear fusion reactor, a material for thermal power generation, etc. in which excellent high-temperature strength and creep strength are required.

Although austenitic stainless steels have hitherto been used in the component members of nuclear reactors, especially fast reactors which are required to have excellent high-temperature strength and resistance to neutron irradiation, they have limitations on irradiation resistance such as swelling resistance. On the other hand, martensitic stainless steels have the disadvantage of low high-temperature strength although they are excellent in irradiation resistance.

Therefore, oxide dispersion strengthened martensitic steels have been developed as materials that combined irradiation resistance and high-temperature strength, and there have been proposed techniques for improving high-temperature strength by adding Ti to oxide dispersion strengthened martensitic steels, thereby finely dispersing oxide particles.

For example, Japanese Patent Publication No. 5-18897/1993 discloses a tempered oxide dispersion strengthened martensitic steel which comprises, as expressed by % by weight, 0.05 to 0.25% C, not more than 0.1% Si, not more than 0.1% Mn, 8 to 12% Cr (12% being excluded), 0.1 to 4.0% in total of Mo+W, not more than 0.01% O (O in $Y_2O_3$ and $TiO_2$ being excluded) with the balance being Fe and unavoidable impurities, and in which complex oxide particles comprising $Y_2O_3$ and $TiO_2$ having an average particle diameter of not more than 1,000 angstroms are homogeneously dispersed in the matrix in an amount of 0.1 to 1.0% in total of $Y_2O_3$+$TiO_2$ and in the range of 0.5 to 2.0 of the molecular ratio $TiO_2/Y_2O_3$.

However, even when oxide dispersion strengthened martensitic steels are produced by adjusting the total amount of $Y_2O_3$ and $TiO_2$ and the ratio of these oxides as disclosed in Japanese Patent Publication No. 5-18897/1993, there are cases where oxide particles are not finely dispersed in a homogeneous manner and it follows that in such cases the expected effect on an improvement in high-temperature strength cannot be achieved.

SUMMARY OF THE INVENTION

An object of the present invention is, therefore, to provide a method that can reliably provide grains in which oxide particles are finely and homogeneously dispersed in high density and, as a result, can manufacture the oxide dispersion strengthened martensitic steel which develops excellent high-temperature strength.

The inventors have found that, when the oxide dispersion strengthened martensitic steel is manufactured by a method which comprises subjecting raw material powders to mechanical alloying treatment, solidifying the resulting alloyed powder to hot extrusion, and subjecting the resulting extruded solidified material to final heat treatment involving normalizing and tempering heat treatment, high-temperature strength can be reliably improved by preventing α to γ transformation from occurring during hot extrusion and increasing the proportion of residual α-grains in which oxide particles are finely dispersed in high density, and further the proportion of the residual α-grains can be increased by adjusting an excess oxygen content in steel (a value obtained by subtracting an oxygen content in $Y_2O_3$ from an oxygen content in steel) within a predetermined range, thus having accomplished the present invention.

A method of manufacturing oxide dispersion strengthened martensitic steel excellent in high-temperature strength having residual α-grains comprises mixing either element powders or alloy powders and a $Y_2O_3$ powder to form a mixed powder; subjecting the mixed powder to mechanical alloying treatment to form an alloyed powder; solidifying the alloyed powder by hot extrusion to form an extruded solidified material; and subjecting the extruded solidified material to final heat treatment involving normalizing and tempering heat treatment to thereby manufacture an oxide dispersion strengthened martensitic steel which comprises, as expressed by % by weight, 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, characterized in that α to γ transformation is not allowed to occur during the hot extrusion and the proportion of residual α-grains in which oxide particles are finely dispersed in high density is increased by controlling the mixture ratio of the powders for the mechanical alloying treatment so that an excess oxygen content in the steel satisfies $$0.22\times Ti<ExO<0.32-8C/3+2Ti/3$$

wherein ExO: excess oxygen content in steel, % by weight,

Ti: Ti content in steel, % by weight,

C: C content in steel, % by weight, wherein the excess oxygen content ExO is an amount obtained by subtracting an oxygen content in $Y_2O_3$ from the total oxygen content in steel on the assumption that all of Y are present as $Y_2O_3$ and is calculated according to the following expression:

$$ExO=O_{total}-0.27Y$$

wherein $O_{total}$: total oxygen content in steel, % by weight,

Y: an amount of Y in steel, % by weight.

Incidentally, in the following descriptions of this specification, "%" denotes "% by weight" unless otherwise specified.

In the present invention, the proportion of residual α-grains produced during hot extrusion is increased by suitably adjusting a powder mixture ratio for mechanical alloying treatment so that an excess oxygen content in steel is within a predetermined range. Oxide particles dispersed in the residual α-grains are finer and have higher density than oxide particles dispersed in transformed γ-grains produced in α to γ transformation during hot extrusion. As a result, according to the present invention, increase of the proportion of the residual α-grains produced during hot extrusion allows the oxide dispersion strengthened martensitic steel excellent in high-temperature strength to be obtained.

PREFERRED EMBODIMENTS OF THE INVENTION

Figure 1:
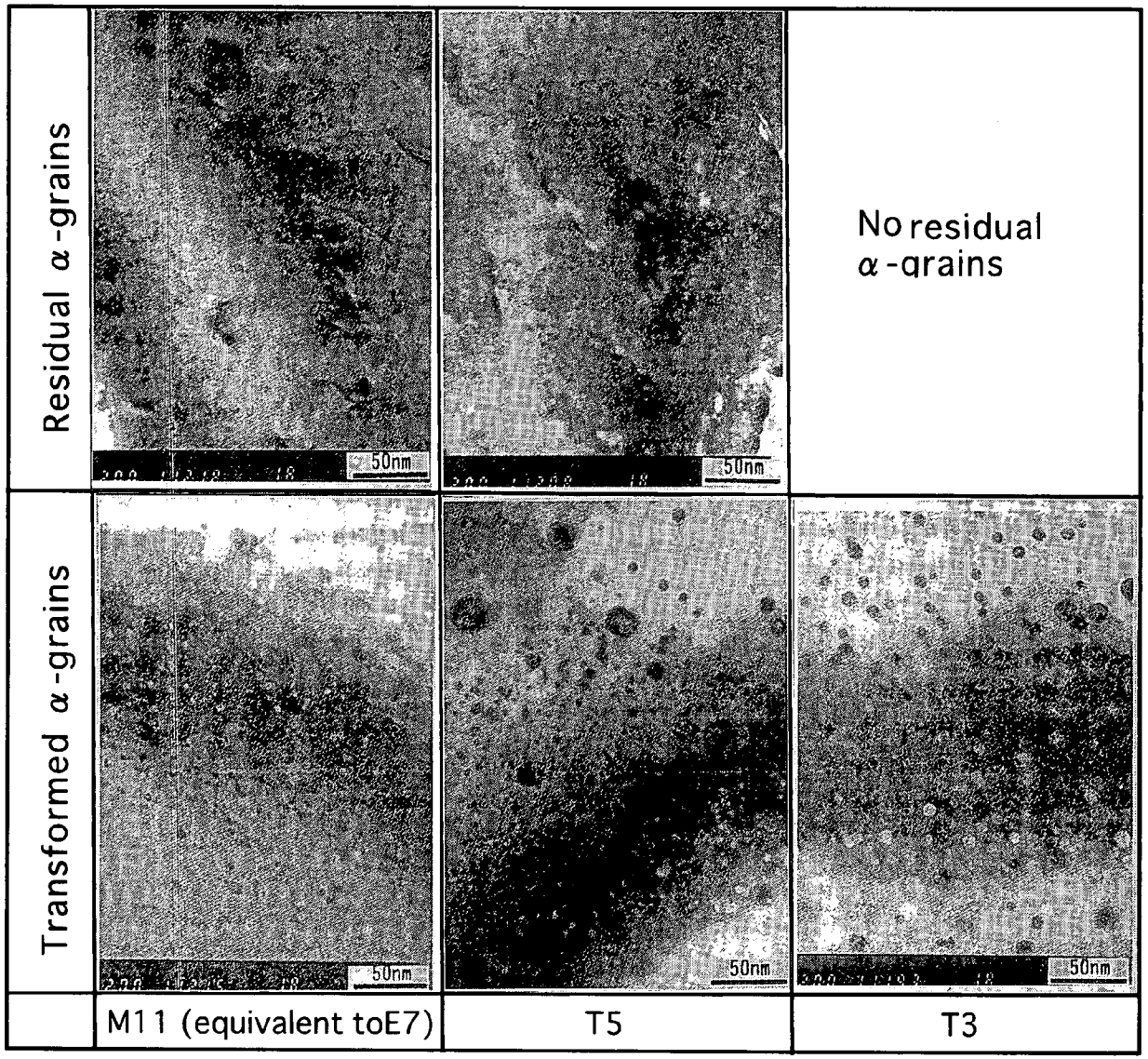
FIG. 1 shows transmission electron microphotographs of respective test materials.

The chemical composition of the oxide dispersion strengthened martensitic steel of the present invention and the reasons for the limitation of its compositions will be described below.

Cr (chromium) is an element important for ensuring corrosion resistance, and if the Cr content is less than 8.0%, the worsening of corrosion resistance becomes remarkable. If the Cr content exceeds 12.0%, a decrease in toughness and ductility is feared. For this reason, the Cr content should be 8.0 to 12.0%.

When the Cr content is 8.0 to 12.0%, it is necessary that C (carbon) be contained in an amount of not less than 0.05% in order to make the structure a stable martensitic structure. This martensitic structure is obtained by conducting heat treatment including normalizing at 1,000° C. to 1,150° C.+tempering at 700° C. to 800° C. The higher the C content, the amount of precipitated carbides ($M_{23}C_6$, $M_6C$ and the like) and high-temperature strength increases. However, workability deteriorates if C is contained in an amount of exceeding 0.25%. For this reason, the C content should be 0.05 to 0.25%.

W (tungsten) is an important element which dissolves into an alloy in a solid solution state to improve high-temperature strength, and is added in an amount of not less than 0.1%. A high W content improves creep rupture strength due to the solid-solution strengthening, the strengthening by carbide ($M_{23}C_6$, $M_6C$, etc.) precipitation and the strengthening by intermetallic compound precipitation. However, if the W content exceeds 4.0%, the amount of δ-ferrite increases and contrarily strength decreases. For this reason, the W content should be 0.1 to 4.0%.

Ti (titanium) plays an important role in the dispersion strengthening of $Y_2O_3$ and forms the complex oxide $Y_2Ti_2O_7$ or $Y_2TiO_5$ by reacting with $Y_2O_3$, thereby functioning to finely disperse oxide particles. This action tends to reach a level of saturation when the Ti content exceeds 1.0%, and the finely dispersing action is small when the Ti content is less than 0.1%. For this reason, the Ti content should be 0.1 to 1.0%.

$Y_2O_3$ is an important additive which improves high-temperature strength due to dispersion strengthening. When the $Y_2O_3$ content is less than 0.1%, the effect of dispersion strengthening is small and strength is low. On the other hand, when $Y_2O_3$ is contained in an amount exceeding 0.5%, hardening occurs remarkably and a problem arises in workability. For this reason, the $Y_2O_3$ content should be 0.1 to 0.5%.

A method described below may be used as a general manufacturing method of the oxide dispersion strengthened martensitic steel of the present invention. The above-described components as either element powders or alloy powders and a $Y_2O_3$ powder are mixed so as to obtain a target composition. The resulting powder mixture is subjected to mechanical alloying which comprises charging the powder mixture into a high-energy attritor and stirring the powder mixture in an Ar atmosphere. Thereafter, the resulting alloyed powder is filled in a capsule made of mild steel for extrusion. The capsule is then degassed and sealed, and hot extrusion, for example, at 1,150° C. to 1,200° C. in an extrusion ratio of 7 to 8:1 is carried out to thereby solidify the alloyed powder. The solidified material is then subjected to final heat treatment involving normalizing and tempering heat treatment, for example, normalizing (1,050° C.×1 hr, air cooling)+tempering (780° C.×1 hr, air cooling).

In the oxide dispersion strengthened martensitic steel, there are two cases depending on the chemical composition thereof, that is, a case where complete α to γ transformation occurs during hot extrusion to form a single-phase structure of transformed γ-grains and a case where the α to γ transformation does not occur completely, but residual α-grains which retain an α-phase are produced to form a dual-phase structure. The transformed γ-grains are transformed by subsequent heat treatment, for example, transformed to martensitic grains by subjecting the same to normalizing heat treatment and transformed to α-grains by subjecting the same to furnace cooling heat treatment. (Hereinafter, in the present specification, transformed γ-grains, transformed martensitic grains and transformed α-grains are collectively called as "transformed grains".) On the other hand, residual α-grains during hot extrusion retain the α-phase even when subsequent heat treatment is subjected thereto, and the dispersed oxide particles in the α-grains are finer and have higher density than those in the transformed grains.

Accordingly, a structure in which oxide particles are dispersed finely and in high density can be obtained by increasing the residual α-grains as much as possible during hot extrusion. In the present invention, the proportion of the residual α-grains during hot extrusion is increased by bringing the excess oxygen content in steel into a predetermined range by adjusting the mixture ratio of raw material powders to be formulated, particularly the amount of Ti content, for mechanical alloying treatment.

TEST EXAMPLES

Table 1 collectively shows the target compositions of test materials of oxide dispersion strengthened martensitic steel and the features of the compositions.

TABLE 1

| Test material | Target composition | Features |
|---|---|---|
| Mm11, E5, E7 | 0.13C-9Cr-2W-0.20Ti-0.35$Y_2O_3$ | Standard material |
| T14 | 0.13C-9Cr-2W-0.20Ti-0.35$Y_2O_3$ | Higher excess oxygen content |
| T3 | 0.13C-9Cr-2W-0.20Ti-0.35$Y_2O_3$-0.17$Fe_2O_3$ | Increase of excess oxygen |
| T4 | 0.13C-9Cr-2W-0.50Ti-0.35$Y_2O_3$ | Increase of Ti |
| T5 | 0.13C-9Cr-2W-0.50Ti-0.35$Y_2O_3$-0.33$Fe_2O_3$ | Increase of Ti and excess oxygen |
| Y1 | 0.13C-9Cr-2W-0.2Ti-0.28Y | Addition of metal Y<br>Target excess oxygen content: 0 wt % |
| Y2 | 0.13C-9Cr-2W-0.2Ti-0.28Y-0.15$Fe_2O_3$ | Addition of metal Y + $Fe_2O_3$<br>Target excess oxygen content: 0.04 wt % |
| Y3 | 0.13C-9Cr-2W-0.2Ti-0.28Y-0.29$Fe_2O_3$ | Addition of metal Y + $Fe_2O_3$<br>Target excess oxygen content: 0.08 wt % |

In each test material, either element powders or alloy powders and a $Y_2O_3$ powder were blended to obtain a target composition, charged into a high-energy attritor and thereafter subjected to mechanical alloying treatment by stirring in an Ar atmosphere. The number of revolutions of the attritor was about 220 revolutions per minute (rpm) and the stirring time was about 48 hours. The resulting alloyed powder was filled in a capsule made of mild steel, degassed at a high temperature in a vacuum, and then subjected to hot extrusion at about 1,150° C. to 1,200° C. in an extrusion ratio of 7 to 8:1, to thereby obtain a hot extruded rod-shaped material.

In each of the test materials shown in Table 1, not only a $Y_2O_3$ powder but also Ti was added to try to finely disperse and highly densify dispersed oxide particles by formation of complex oxide of Ti and Y. Mm11, E5 and E7 are standard materials having a basic composition and T14 is a steel having an excess oxygen content of a little higher. T3 is a steel in which an unstable oxide ($Fe_2O_3$) is added to the basic composition to intentionally increase the excess oxygen content; T4 is a steel in which the amount of Ti content is increased relative to the basic composition; T5 is a steel in which the amount of Ti content is increased to about 0.5% and an unstable oxide ($Fe_2O_3$) is added to increase the excess oxygen content.

In Y1, Y2 and Y3, a metal Y powder is added in place of a $Y_2O_3$ powder. Specifically, Y1 has a target excess oxygen content of 0% by adding a metal Y powder without adding an unstable oxide ($Fe_2O_3$). Y2 and Y3 each has a target excess oxygen content of 0.04% and 0.08%, respectively, by adding 0.15% and 0.29% $Fe_2O_3$ powder, respectively, together with a metal Y powder.

Table 2 collectively shows the results of chemical analysis of each test material which was prepared as described above.

TABLE 2

| | Chemical compositions (wt %) | | | | | | | | | | | | | | |
|---|---|---|---|---|---|---|---|---|---|---|---|---|---|---|---|
| | C | Si | Mn | P | S | Ni | Cr | W | Ti | Y | O | N | Ar | $Y_2O_3$ | ExO |
| Mm11 | 0.14 | <0.01 | <0.01 | 0.002 | 0.003 | <0.01 | 9.00 | 1.92 | 0.20 | 0.28 | 0.15 | 0.0092 | 0.0028 | 0.36 | 0.07 |
| E5 | 0.13 | <0.005 | <0.01 | <0.005 | 0.002 | 0.01 | 8.89 | 1.97 | 0.21 | 0.28 | 0.16 | 0.0087 | 0.0048 | 0.36 | 0.084 |
| E7 | 0.14 | 0.007 | 0.02 | <0.005 | 0.003 | 0.02 | 8.92 | 1.97 | 0.20 | 0.27 | 0.16 | 0.0099 | 0.0047 | 0.34 | 0.087 |
| T14 | 0.14 | <0.005 | <0.01 | 0.002 | 0.003 | 0.04 | 8.80 | 1.96 | 0.21 | 0.26 | 0.18 | 0.013 | 0.0049 | 0.33 | 0.11 |
| T3 | 0.13 | <0.005 | <0.01 | 0.002 | 0.003 | 0.01 | 8.75 | 1.93 | 0.21 | 0.27 | 0.22 | 0.012 | 0.0049 | 0.34 | 0.147 |
| T4 | 0.13 | <0.005 | <0.01 | 0.002 | 0.003 | 0.01 | 8.72 | 1.93 | 0.46 | 0.27 | 0.18 | 0.009 | 0.0051 | 0.34 | 0.107 |
| T5 | 0.13 | <0.005 | <0.01 | 0.002 | 0.003 | 0.01 | 8.75 | 1.93 | 0.46 | 0.27 | 0.24 | 0.011 | 0.0052 | 0.34 | 0.167 |
| Y1 | 0.13 | 0.012 | <0.01 | <0.005 | 0.002 | 0.01 | 8.85 | 1.93 | 0.20 | 0.27 | 0.099 | 0.014 | 0.0054 | 0.34 | 0.026 |
| Y2 | 0.13 | 0.005 | <0.01 | <0.005 | 0.002 | 0.01 | 8.87 | 1.96 | 0.21 | 0.28 | 0.12 | 0.012 | 0.0055 | 0.36 | 0.044 |
| Y3 | 0.14 | 0.020 | <0.01 | <0.005 | 0.002 | <0.01 | 8.86 | 1.97 | 0.21 | 0.28 | 0.18 | 0.010 | 0.0050 | 0.36 | 0.104 |

(1) Dispersion State of Oxides

As described above, in the oxide dispersion strengthened martensitic steel, there are two cases depending on the chemical composition thereof, that is, a case where complete α to γ transformation occurs during hot extrusion to form a single-phase structure of transformed γ-grains and a case where the α to γ transformation does not occur completely, but residual α-grains which retain an α-phase are produced to form a two-phase structure.

FIG. 1 shows thin-film transmission electron microphotographs of residual α-grains and transformed α-grains in each test material of Mm11, T5and T3. Incidentally, the electron microphotographs in FIG. 1 are for structures which are obtained by subjecting each test material to hot extrusion and then subjecting the resulting material to furnace cooling heat treatment in which a slow cooling is performed at a low cooling rate, in order to allow an easy observation of oxide particles. When transformed γ-grains which are transformed to γ-grains by α to γ transformation during hot extrusion are subjected to furnace cooling heat treatment, γ to α transformation occurs to form transformed α-grains. On the other hand, residual α-grains which have not undergone α to γ transformation during hot extrusion remain as fine α-grains even when subjected to furnace cooling heat treatment. Mm11 (a material equivalent to E7) having a low excess oxygen content and T5 having a high amount of Ti content make a dual-phase structure consisting of transformed α-grains (coarse grains) which are produced by furnace cooling heat treatment and residual α-grains (fine grains)

which have not undergone transformation even when subjected to the furnace cooling heat treatment. On the other hand, T3 having a high excess oxygen content makes a single-phase structure consisting of transformed α-grains (coarse grains). In other words, complete α to γ transformation has occurred during the hot extrusion of T3, while residual α-grains have been produced which have not undergone α to γ transformation during the hot extrusion of Mm11 and T5.

Figure 2:
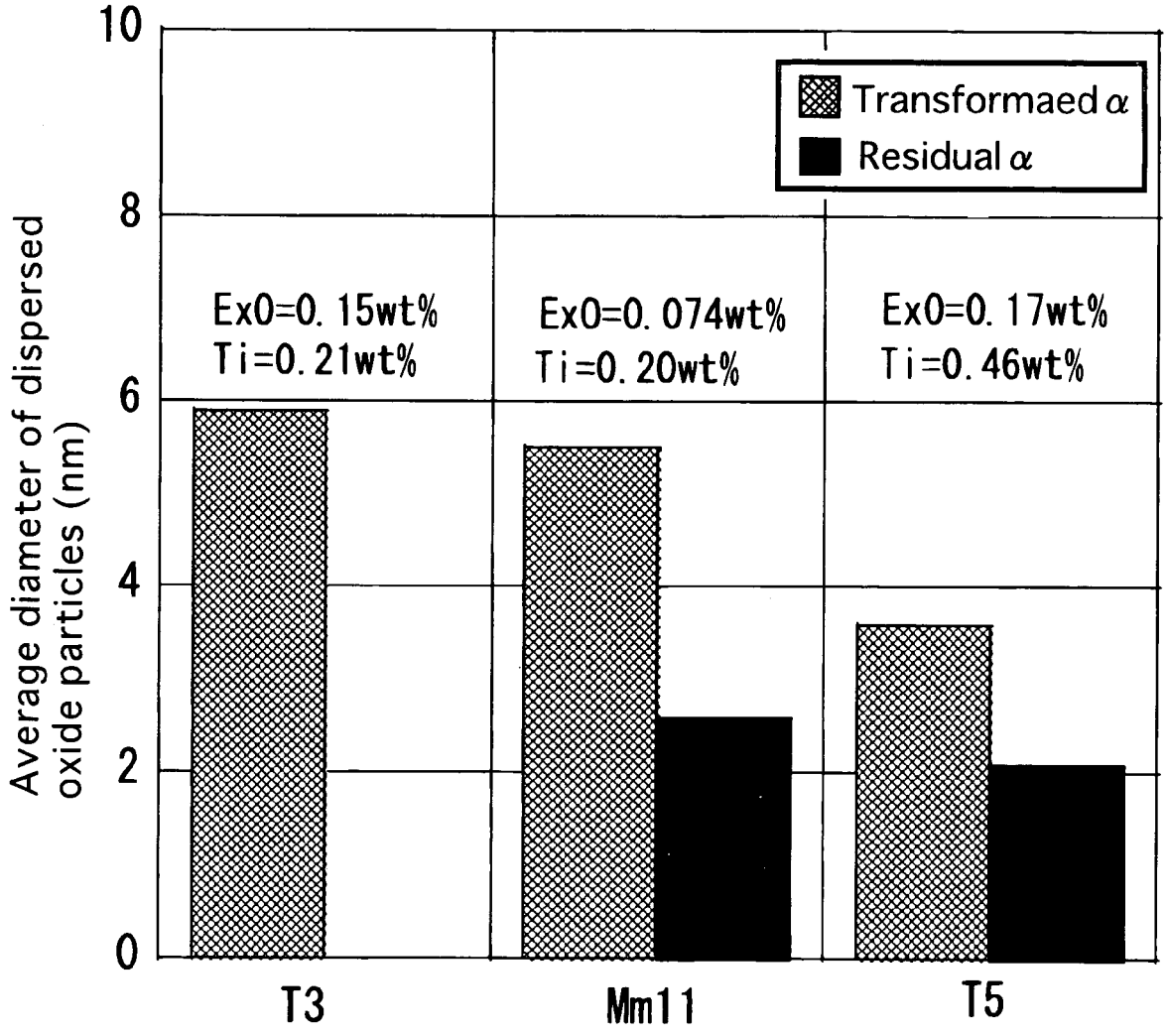
FIG. 2 is a graph showing the results of the determination of the average particle size of dispersed oxide particles.

FIG. 2 shows the results of the determination of the average particle size of dispersed oxide particles by the image analysis of the transmission electron microphotographs in FIG. 1. As is understood from FIG. 2, the size of dispersed oxide particles in residual α-grains is finely divided into about half of size of oxide dispersion particles in transformed α-grains. It is clear from these results that the introduction of residual α-grains is effective for obtaining a finely-dispersed and high-density oxide particle structure that is important to improve high-temperature strength.

(2) Control of the Amount of Residual α-Grains

The proportion of the formation of residual α-grains depends on the amount of C which is a strong γ-former element. Specifically, when the amount of C in the matrix is suppressed to low, the α to γ transformation during hot extrusion and during final heat treatment at 1,050° C. is reduced to increase the proportion of residual α-grains.

Although Ti is added in the oxide dispersion strengthened martensitic steel for finely dispersing oxide particles, since Ti has a strong affinity for carbide formation, excess addition of Ti reduces the amount of dissolved C in the matrix due to the formation of Ti carbides, and increases residual α-grains. However, since excessive reduction of excess oxygen content reduces the number density of dispersed oxide particles, residual α-grains will be reduced due to the reduction of the transformation suppression effect by the dispersed oxide particles. On the other hand, since Ti oxides are stabler than Ti carbides, the increase of excess oxygen content suppresses the formation of Ti carbides due to the formation of Ti oxides to increase the amount of dissolved C in the matrix, thereby generating adequate α to γ transformation during hot extrusion and during final heat treatment at 1,050° C., and reducing residual α-grains. For the reasons described above, it is understood that the control of excess oxygen content and the amount of Ti content allows the proportion of residual α-grains to be controlled. For example, when TiOx (atomic percentage ratio of ExO/Ti) is used as a parameter for control, the reduction of TiOx facilitates the formation of Ti carbides to reduce the amount of dissolved C in the matrix and increase residual α-grains.

Residual α-grains are stretched during hot extrusion to form elongated grains, which are maintained even after subjected to subsequent normalizing and tempering heat treatment. On the other hand, transformed γ-grains which have undergone α to γ transformation during hot extrusion are also stretched to form elongated grains by the hot extrusion, but the grains are divided into equiaxed martensitic grains during subsequent normalizing and tempering heat treatment. Therefore, it is possible to determine that in the metallographic structures after the normalizing and tempering heat treatment, elongated grains are residual α-grains and fine equiaxed grains are transformed grains (martensitic grains).

Figure 3:
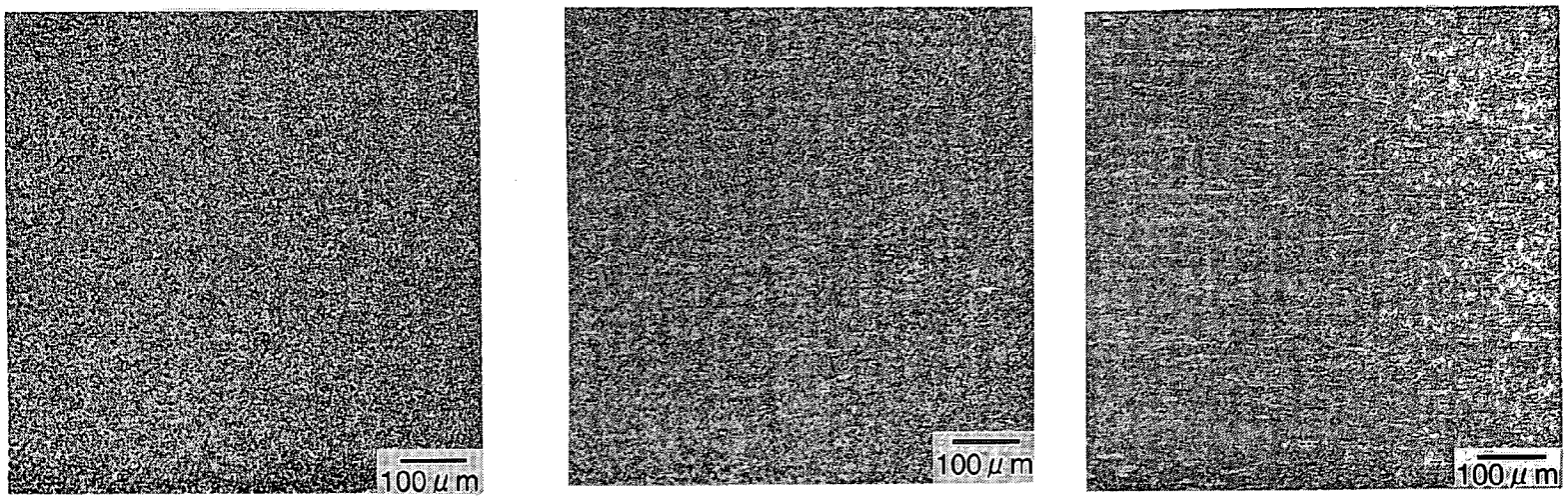
FIG. 3 shows optical microphotographs of metallographic structures of respective test materials.
Figure 3:
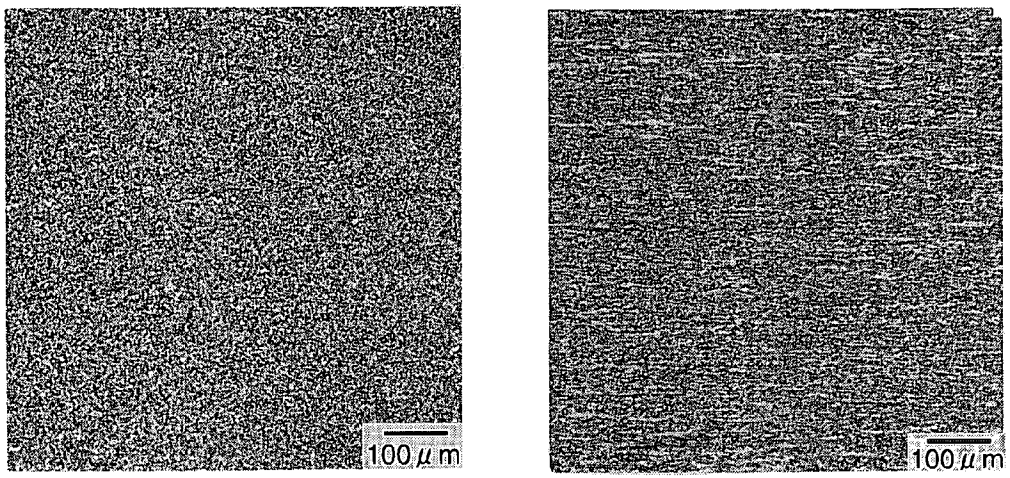

FIG. 3 shows optical microphotographs of metallographic structures of respective test materials different in the amount of Ti content and excess oxygen content after normalizing and tempering heat treatment. For a test material in which 0.2% Ti is added, T3 in which excess oxygen content is increased and Y1 and Y2 in which excess oxygen content is reduced by adding metal Y have fine and equiaxed transformed grains (martensitic grains), while the standard material E7 (a material equivalent to Mm11) which has excess oxygen content of around 0.08% has a structure in which elongated residual α-grains and fine equiaxed transformed grains (martensitic grains) are mixed. In addition, T5 in which excess oxygen content is increased also has a dual-phase structure in which elongated residual α-grains and fine equiaxed transformed grains (martensitic grains) are mixed, because the amount of Ti content is as high as 0.46%. These results show that reduction of excess oxygen content and increase of the amount of Ti content are effective to the formation of residual α-grains, but excessive reduction of the excess oxygen content reduces residual α-grains. It may be considered that the reduction of residual α-grains due to excessive reduction of excess oxygen content has occurred because the transformation suppression effect by the dispersion of oxides has been reduced by the reduction of the number density of oxide particles.

Figure 4A:
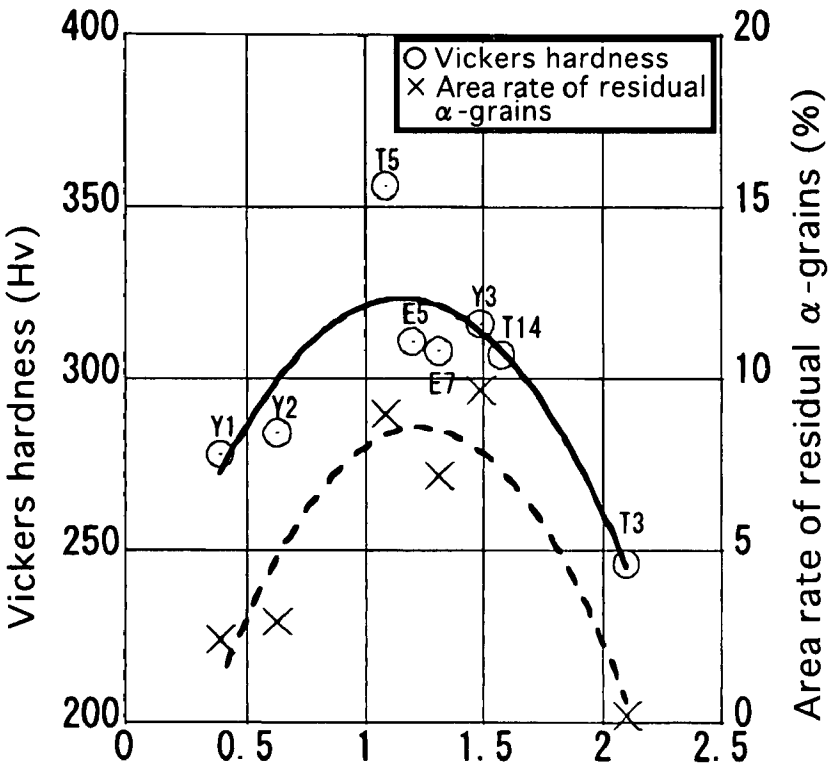
FIGS. 4A and 4B are graphs showing Vickers hardness and an area rate of residual α-grains of each test material. The graph 4A shows the dependence on TiOx and the graph 4B shows the dependence on estimated amount of dissolved C.

The higher the proportion of residual α-grains is, the higher the hardness of steel is, because oxide particles are finely dispersed in high density in the residual α-grains. FIG. 4A is a graph showing the dependence of Vickers hardness of each test material on TiOx. In addition, FIG. 4A also shows the area rate (%) of residual α-grains, for reference, the value of which is calculated by classifying the metallographic structures of each test material into two tones, that is, a region of white elongated grains indicating residual α-grains and a region of black color indicating transformed grains (martensitic grains). From FIG. 4A, it is understood that Vickers hardness reaches its peak at TiOx of around 1. Since Vickers hardness reflects the proportion of residual α-grains, it is considered that the proportion of the residual α-grains also reaches its peak at TiOx of around 1. The reduction of residual α-grains with the increase of TiOx in the range of TiOx>1.0 is due to the reduction of the amount of dissolved C in the matrix by the formation of Ti carbides. Incidentally, it is considered that the reduction of residual α-grains in the range of TiOx<1 is due to the reduction of the number density of dispersed oxide particles to thereby reduce the transformation suppression effect by the dispersed particles.

Figure 4B:
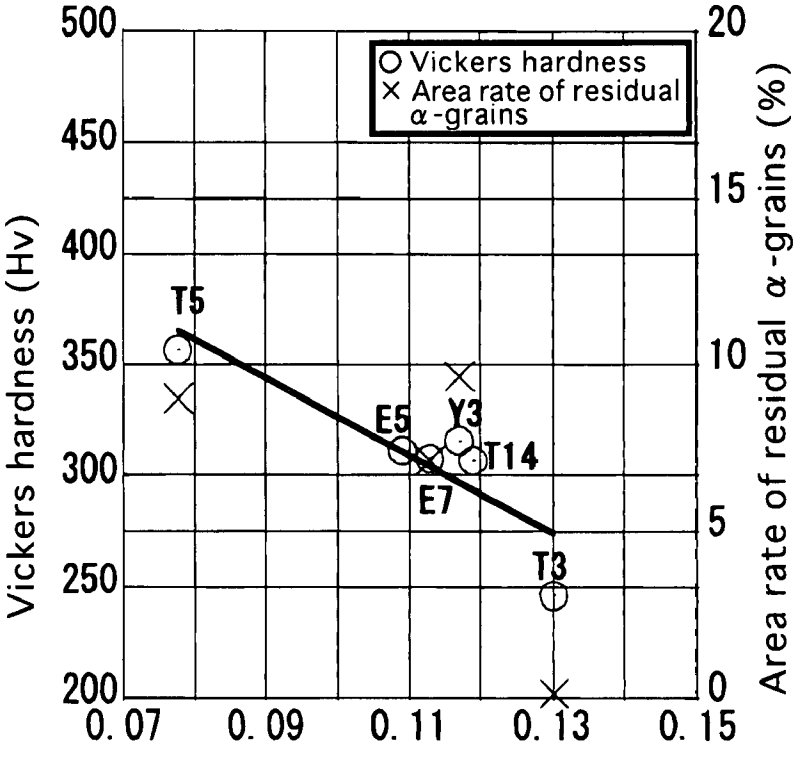

FIG. 4B is a graph showing the results of quantitative evaluation of the dependence of Vickers hardness and the area rate (%) of residual α-grains of each test material on estimated amount of dissolved C, in the case of TiOx>1.0 in FIG. 4A. Here, the estimated amount of dissolved C in the matrix was calculated according to the following expression based on the assumption that Ti preferentially reacts with excess oxygen to form $TiO_2$ and remaining Ti forms TiC together with C to thereby reduce the amount of dissolved C in the matrix:

$$C_s = C - C_{TiC} \quad (1)$$

$$C_{TiC} = \{(Ti/48) - (ExO/16 \times 2)\} \times 12 \quad (2)$$

wherein $C_s$: estimated amount of dissolved C (% by weight),

C: an amount of C added (% by weight), $C_{TiC}$: an amount of C consumed in the formation of TiC, Ti: an amount of Ti added (% by weight), and ExO: excess oxygen content (% by weight).

From FIG. 4B, it is understood that the increase of the amount of Ti content or the decrease of excess oxygen content reduces the amount of dissolved C in the matrix to thereby increase Vickers hardness, that is, the proportion of residual α-grains.

For the reasons described above, it is considered that the proportion of residual α-grains can be controlled by adjusting TiOx content within a suitable range.

Incidentally, in the oxide dispersion strengthened martensitic steel, grains finely stretched in the rolling direction are made eauiaxed utilizing α to γ transformation, and the oxide dispersion strengthened ferritic steel composed of single-phase α-grains cannot utilize such a transformation control.

(3) High-Temperature Strength

Figure 5A:
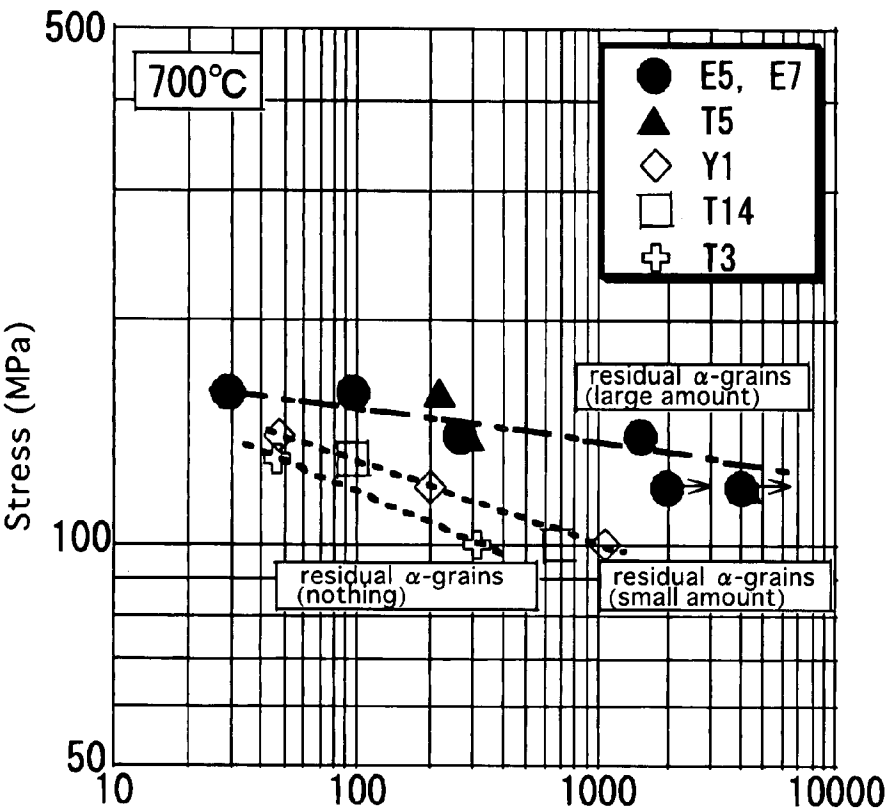
FIGS. 5A and 5B are graphs showing a high-temperature strength of each test material. The graph 5A shows the test results of creep rupture strength and the graph 5B shows the test results of tensile strength.

FIG. 5A shows the test results of creep rupture strength at 700° C. of each test material subjected to final heat treatment involving normalizing and tempering heat treatment (normalizing (1,050° C.×1 hr, air cooling)+tempering (780° C.×1 hr, air cooling)). The creep rupture strengths have been remarkably improved for E5, E7 and T5 containing a larger amount of residual α-grains (an area rate by the image analysis of about 10%) as compared with those for Y1 and T14 containing smaller amount of residual α-grains or T3 containing no residual α-grains. This is because oxide particles in the residual α-grains are finely dispersed in high density.

Figure 5B:
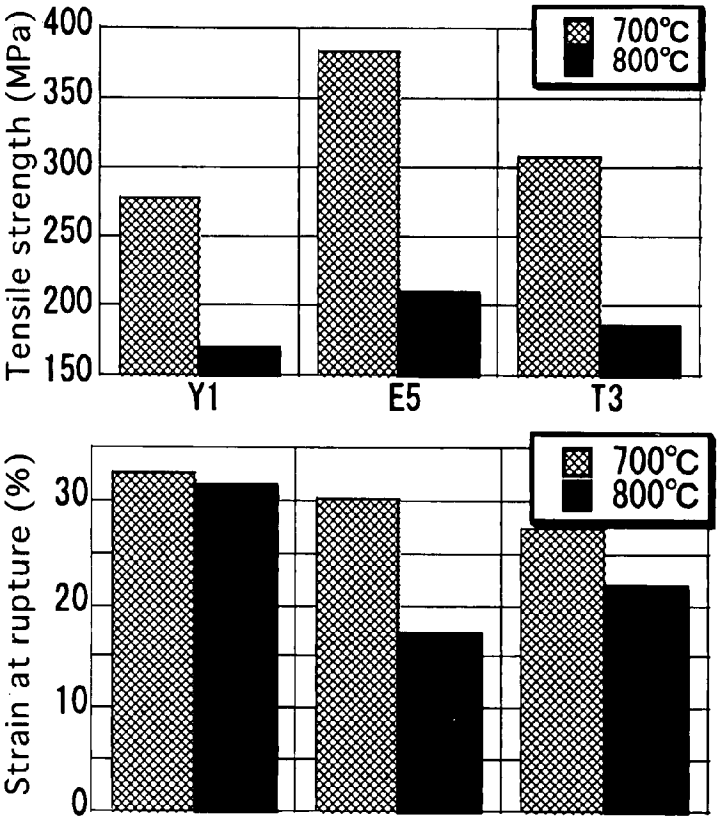

FIG. 5B shows the results of tensile strength tests at 700° C. and 800° C. for test materials Y1, E5 and T3 subjected to final heat treatment similar to those used for the creep rupture strength test. Tensile strength, similar to creep rupture strength, is the highest in E5 in which the amount of residual α-grains reaches its peak at TiOx of around 1. In addition, with respect to the strain at rupture, even E5 having TiOx of around 1 maintains sufficient ductility.

From the investigation described above, it is considered that high-temperature creep rupture strength and high-temperature tensile strength can be improved by increasing residual α-grains in which oxide particles are finely dispersed.

(4) Chemical Composition Range for Improving High-Temperature Strength by Increasing the Amount of Residual α-Grains (4-1) Amount of Ti Content As described above, Ti acts to finely disperse oxide particles by forming a complex oxide with $Y_2O_3$. This action tends to be saturated when the amount of Ti content exceeds 1.0% and is small when it is below 0.1%. Thus, the amount of Ti content is adjusted within a range of 0.1% to 1.0%.

(4-2) Conditional Expression in High TiOx Side (TiOx>1.0)

Figure 6A:
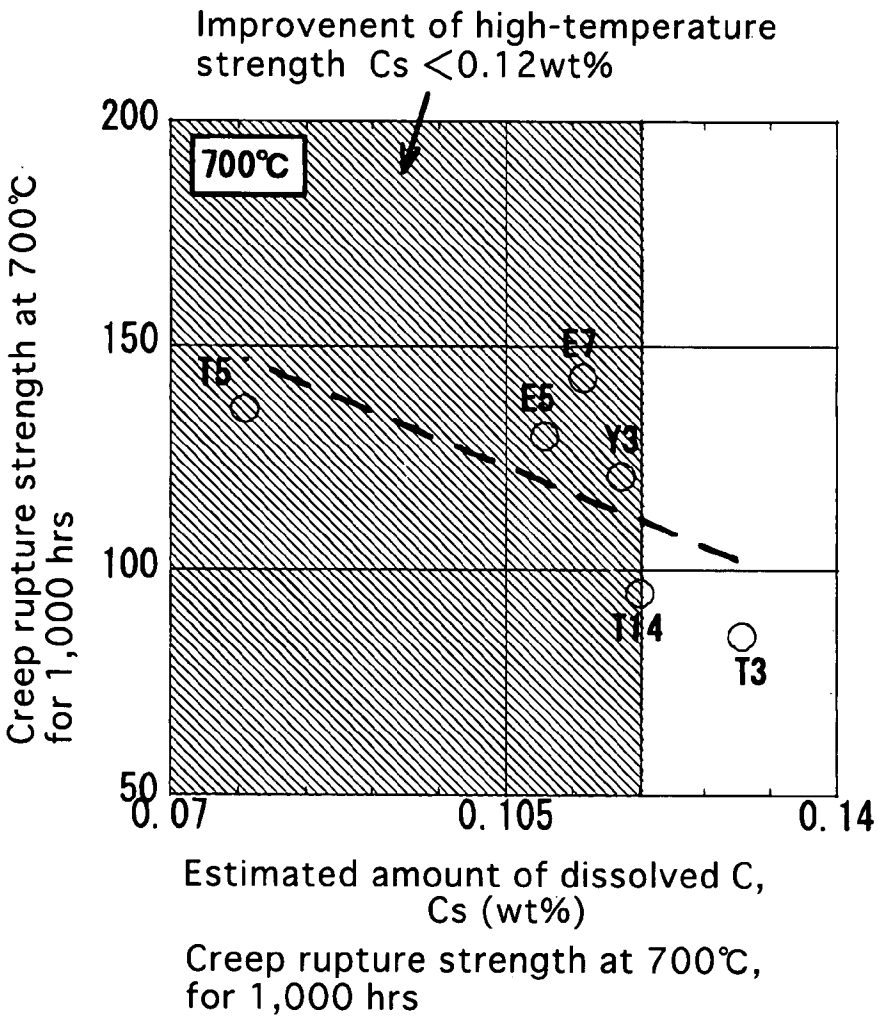
FIGS. 6A and 6B are graphs showing the range of the amount of dissolved C required for improving high-temperature strength by increasing the amount of residual α-grains. The graph 6A shows the dependence of creep rupture strength at 700° C. for 1,000 hours on estimated amount of dissolved C ($C_s$) and the graph 6B shows the dependence of tensile strength on estimated amount of dissolved C ($C_s$).
Figure 6B:
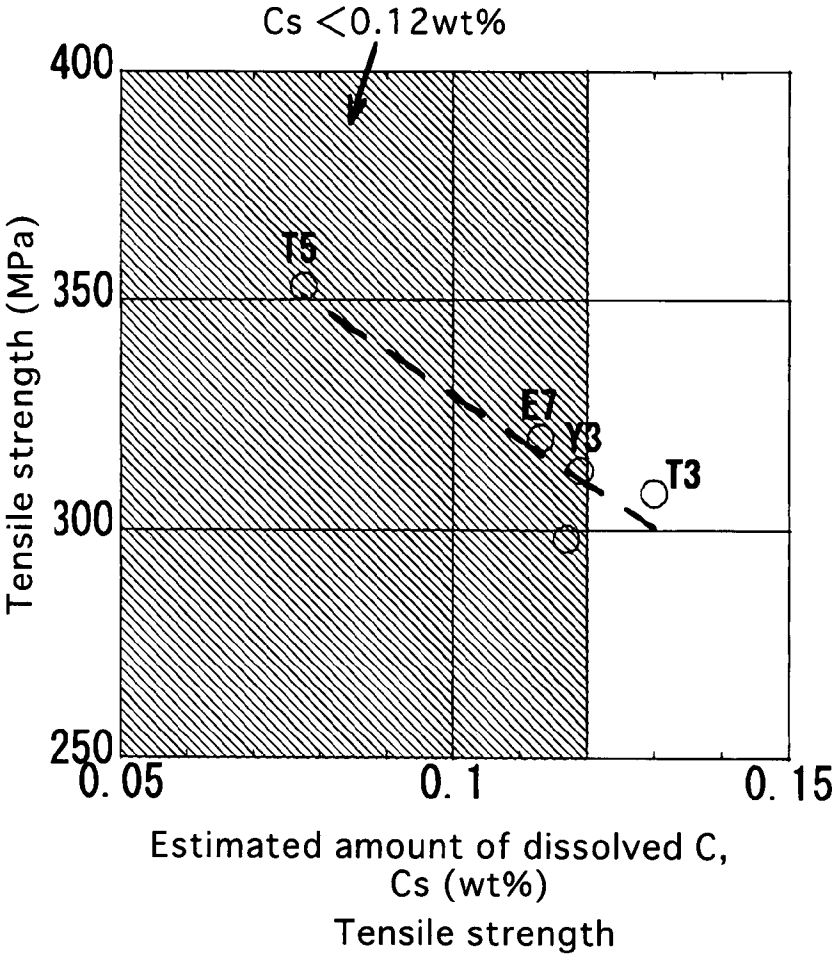

FIG. 6 shows the range of the amount of dissolved C required for improving high-temperature strength by increasing the amount of residual α-grains in a range of TiOx>1.0. FIG. 6A shows the dependence of creep rupture strength at 700° C. for 1,000 hours on estimated amount of dissolved C ($C_s$), and FIG. 6B shows the dependence of tensile strength on estimated amount of dissolved C ($C_s$), respectively. It is understood that, within this range, the residual α-grains increase with the decrease of $C_s$ to improve both creep rupture strength and tensile strength. From FIG. 6, it may be determined that $C_s$<0.12% can ensure both high creep rupture strength and tensile strength.

Thus, the conditional expression for the improvement of high-temperature strength by introducing residual α-grains can be obtained by using expressions (1) and (2) as follows:

$$C_s = C - C_{TiC} = C - \{(Ti/48) - (ExO/16\times 2)\}\times 12 < 0.12 \quad (3)$$

Expression (3) can be modified to the following expression:

$$ExO < 0.32 - 8C/3 + 2Ti/3$$

(4-3) Conditional Expression in Low TiOx Side (TiOx<1.0)

Figure 7A:
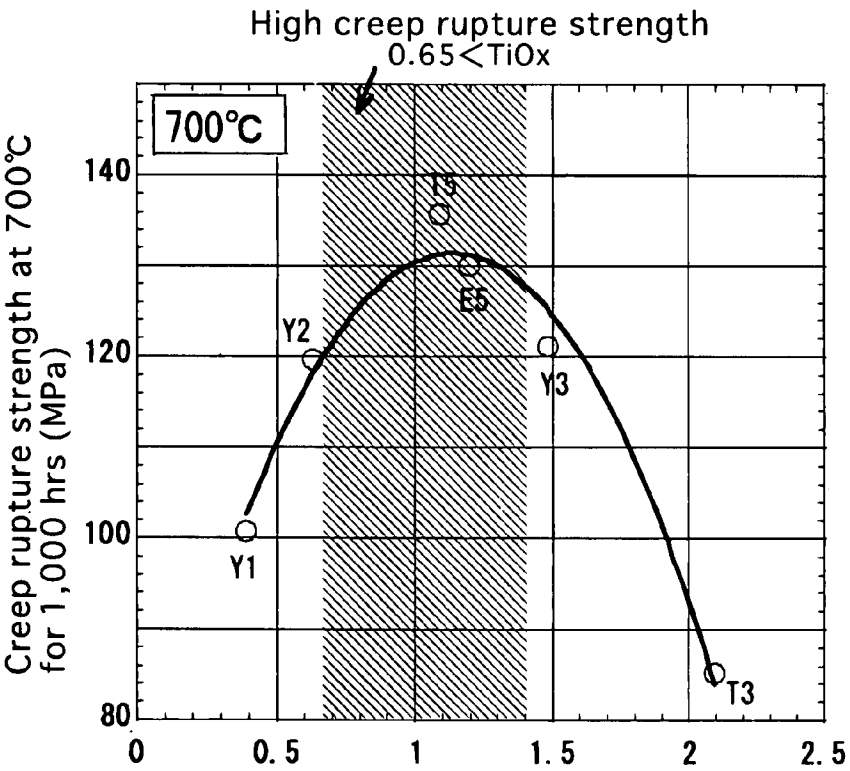
FIGS. 7A and 7B are graphs showing the range of TiOx required for improving high-temperature strength by increasing the amount of residual α-grains. The graph 7A shows the dependence of creep rupture strength at 700° C. for 1,000 hours on TiOx and the graph 7B shows the dependence of tensile strength on TiOx.
Figure 7B:
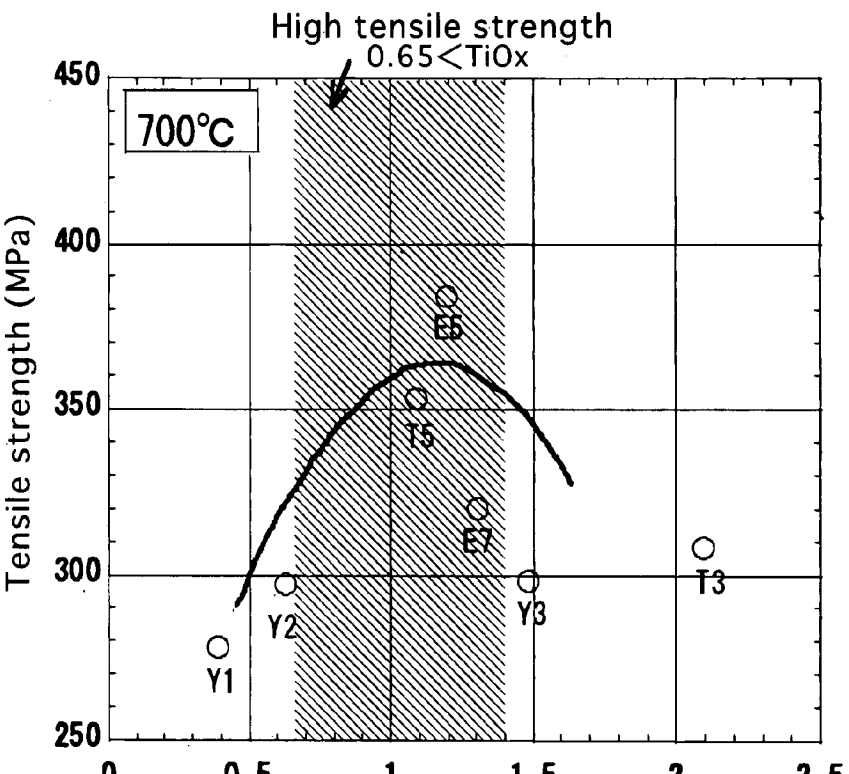

FIG. 7 shows the range of TiOx required for improving high-temperature strength by increasing the amount of residual α-grains. FIG. 7A shows the dependence of creep rupture strength at 700° C. for 1,000 hours on TiOx, and FIG. 7B shows the dependence of tensile strength on TiOx, respectively. When TiOx is below 1, both creep rupture strength and tensile strength decrease. This is because, if TiOx is too low, residual α-grains are reduced due to the decrease of the number density of oxide particles. From FIG. 7, it is concluded that residual α-grains are maintained and sufficient high-temperature strength can be obtained by TiOx>0.65.

Thus, the following relationship can be obtained as the conditional expression for a low TiOx side:

$$ExO' \text{ (atomic \%)} > 0.65Ti' \text{ (atomic \%)}$$

wherein ExO': excess oxygen content (atomic %)

Ti': amount of Ti content (atomic %)

The above described expression can be converted to the unit of % by weight as follows:

$$ExO \text{ (\% by weight)} > 0.22Ti \text{ (\% by weight)} \quad (4)$$

From the above-described explanation, it is understood that the improvement of high-temperature strength by maintaining residual α-grains is made possible by bringing excess oxygen content into a range of [0.22Ti (% by weight)<ExO (% by weight)<0.32−8C/3+2Ti/3] and the amount of Ti content into a range of [0.1<Ti<1.0].

Figure 8:
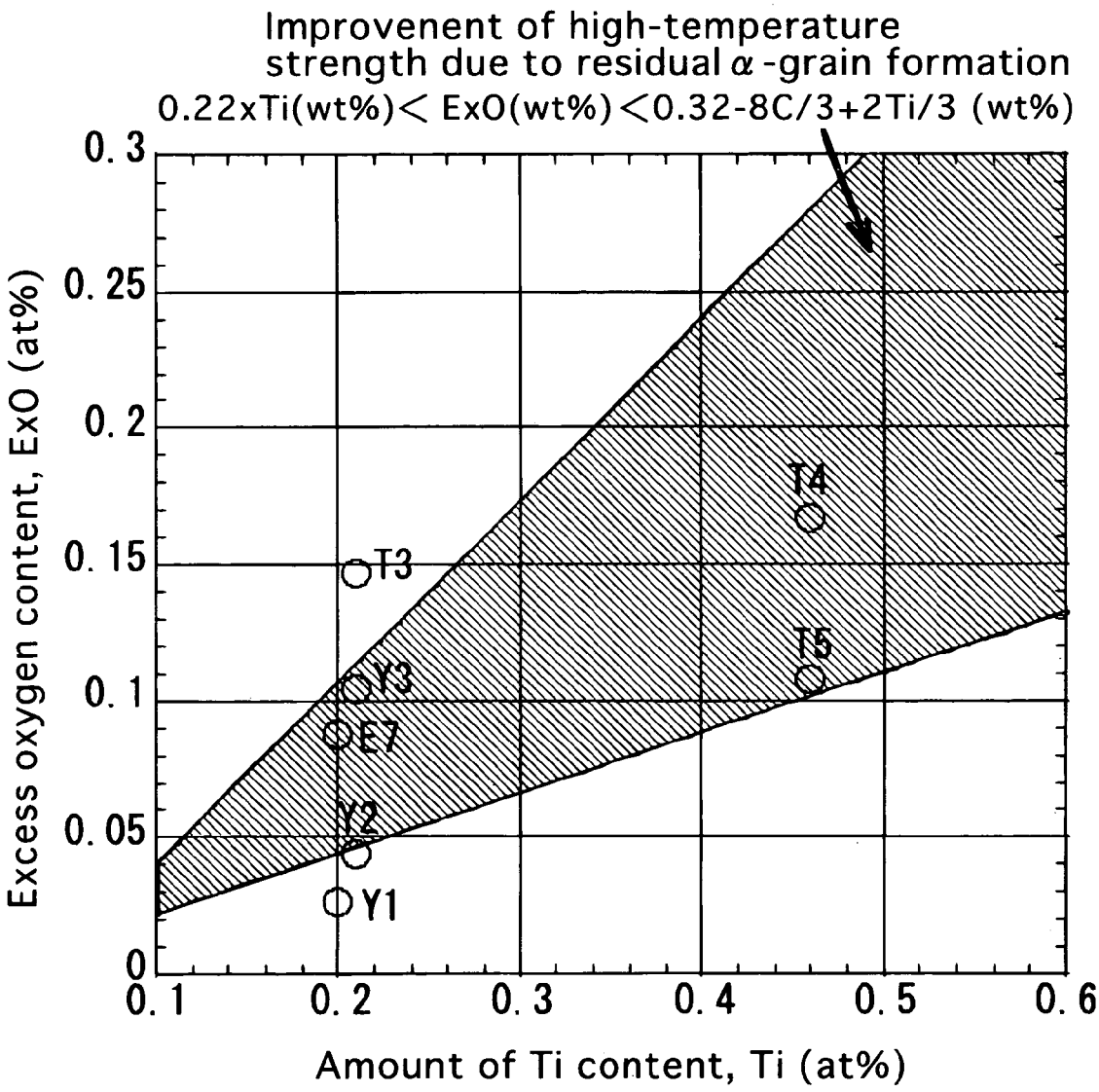
FIG. 8 is a graph plotting the relationship between the amount of Ti content and excess oxygen content for each test material.

FIG. 8 is a graph plotting the relationship between the amount of Ti content and excess oxygen content for each test material, wherein the above described chemical composition range required for improving high-temperature strength by increasing residual α-grains is shown by oblique lines in the graph. Thus, it is understood that test materials having residual α-grains and high high-temperature strength are within the above described chemical composition range (oblique line range in the graph) and that the chemical composition range defined in the above described paragraph (4) is appropriate.

What is claimed is:

1. A method of manufacturing an oxide dispersion strengthened martensitic steel excellent in high-temperature strength having residual α-grains, said method comprising mixing either element powders or alloy powders and a $Y_2O_3$ powder to form a mixed powder; subjecting the mixed powder to mechanical alloying treatment to form an alloyed powder; solidifying the alloyed powder by hot extrusion to form an extruded solidified material; and subjecting the extruded solidified material to final heat treatment involving normalizing and tempering heat treatment to thereby manufacture an oxide dispersion strengthened martensitic steel which comprises, as expressed by % by weight, 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, characterized in that complete α to γ transformation is not allowed to occur during said hot extrusion and the proportion of residual α-grains in which oxide particles are finely dispersed in high density is increased by controlling the mixture ratio of the powders for said mechanical alloying treatment so that an excess oxygen content in the steel satisfies $$0.22\times Ti<ExO<0.32-8C/3+2Ti/3$$

wherein ExO: excess oxygen content in steel, % by weight,

Ti: Ti content in steel, % by weight,

C: C content in steel, % by weight, wherein the excess oxygen content ExO is an amount obtained by subtracting an oxygen content in $Y_2O_3$ from the total oxygen content in steel on the assumption that all of Y are present as $Y_2O_3$ and is calculated according to the following expression:

$$ExO=O_{total}-0.27Y$$

wherein $O_{total}$: total oxygen content in steel, % by weight,

Y: an amount of Y in steel, % by weight.

* * * * *